US009872356B1

(12) United States Patent
Lewis et al.

(10) Patent No.: US 9,872,356 B1
(45) Date of Patent: Jan. 16, 2018

(54) INTERACTIVE LIGHTING HANDSHAKE

(71) Applicant: Google Inc., Mountain View, CA (US)

(72) Inventors: Thor Lewis, Mountain View, CA (US); Melissa-Ann Chan, Mountain View, CA (US)

(73) Assignee: Google LLC, Mountain View, CA (US)

( * ) Notice: Subject to any disclaimer, the term of this patent is extended or adjusted under 35 U.S.C. 154(b) by 219 days.

(21) Appl. No.: 14/613,092

(22) Filed: Feb. 3, 2015

(51) Int. Cl.
*H05B 33/08* (2006.01)
*F21V 23/04* (2006.01)
*F21Y 105/00* (2016.01)

(52) U.S. Cl.
CPC ..... *H05B 33/0854* (2013.01); *H05B 33/0857* (2013.01); *F21V 23/0442* (2013.01); *F21Y 2105/00* (2013.01)

(58) Field of Classification Search
CPC ..... F21V 23/0442; F21Y 2105/00; H05B 33/0854; H05B 33/0857
See application file for complete search history.

(56) References Cited

U.S. PATENT DOCUMENTS

| | | | | |
|---|---|---|---|---|
| 8,427,076 | B2 | 4/2013 | Bourquin | |
| 2010/0092031 | A1* | 4/2010 | Bergeron | G06K 9/2018 382/103 |
| 2011/0096322 | A1* | 4/2011 | Nakanishi | G06F 3/0428 356/51 |
| 2012/0206050 | A1 | 8/2012 | Spero | |
| 2013/0249410 | A1* | 9/2013 | Thompson | H05B 37/0227 315/158 |
| 2013/0335546 | A1* | 12/2013 | Crane | G06F 3/013 348/78 |
| 2014/0300541 | A1 | 10/2014 | Skogoe | |
| 2014/0343699 | A1 | 11/2014 | Engelen | |

* cited by examiner

*Primary Examiner* — Thai Pham
*Assistant Examiner* — Borna Alaeddini
(74) *Attorney, Agent, or Firm* — McDonnell Boehnen Hulbert & Berghoff LLP

(57) ABSTRACT

Example embodiments for interactive lighting handshakes are described herein. An example interactive system may detect a user in a position proximate to an interface of the system and responsively determine an area that encompasses the position of the user. The interactive system may further cause a light system to illuminate the determined area using a light handshake. In some instances, the interactive system may perform a lighting handshake by illuminating a given aspect of the interface of the system and subsequently extending the illumination in a visual presentation from the interface to further encompass the position of the user.

18 Claims, 13 Drawing Sheets

INTERACTIVE LIGHTING HANDSHAKE

BACKGROUND

Unless otherwise indicated herein, the materials described in this section are not prior art to the claims in this application and are not admitted to be prior art by inclusion in this section.

A computing system may provide a user with an interactive experience for any number of different applications, including navigation, gaming, shopping, or the presentation of other types of data or information. Such a computing system may include one or more different input devices that allow a user to instruct or otherwise communicate information to the system. For example, the system may include an input device such as a touchpad that allows a user to provide input through touch, a pointing device that allows a user to input spatial data to the system, or a microphone that allows a user to provide input through speech. Based on information received from the input device, the computing system may provide output back to the user. For instance, the system may include an output device such as a video screen to provide a user with visual feedback or speakers to provide a user with auditory feedback. In some systems, the feedback may be adjusted based on input provided by the user in order to provide the user with an interactive experience.

SUMMARY

Examples may relate to interactive lighting handshakes. An interactive lighting handshake may involve the use of one or more lights to relay information to a user or users. A computing device operating in a system with a lighting system may execute one or more interactive lighting handshakes in response to detecting the presence or inputs of a user. Similar to audio or visual signals, the system may provide lights in certain ways that provide information to users. For instance, the system may process incoming sensor information to detect the presence of a user and responsively cause a lighting system to perform an interactive lighting handshake that provides information to the user.

As an example illustration of an interactive lighting handshake, an interactive system may initially light up an aspect of a component (e.g., podium) of the system positioned nearby a user and subsequently extend the light to extend from the aspect of the component to further include an area that encompasses the user. The presentation of visually extending or moving light from the component to further encompass an area including the user may appear as a visual handshake of light that can enhance the overall experience of interacting with the system. Likewise, in another example implementation of a lighting handshake, the system may initially illuminate an area encompassing the user and subsequently extend the illumination towards an interface of the system. This visual movement of the illumination may inform the user that the interface is available for interaction.

As shown above, interactive lighting handshakes may vary in example implementations. In some examples, the interactive system may illuminates lights (e.g., LEDs) positioned on or within a component of the system. For instance, the interactive system may illuminate strips of LEDs positioned on the floor of the system. Similarly, the interactive system may use beams of light, such as spot lights in order to illuminate areas from above. In some instances, the interactive system may use a combination of light types to execute an interactive lighting handshake.

In one example, the present application describes a method. The method may comprise detecting, at a computing device associated with a light system, a user in a position proximate to an interface of the computing device. Responsive to detecting the user, the method may include determining an area that encompasses the position of the user, and causing, by the computing device, the light system to illuminate the determined area using a light handshake. In some instances, the light handshake may comprise illuminating a given aspect of the interface of the computing device and subsequently extending the illumination in a visual presentation from the given aspect of the interface of the computing to encompass the position of the user.

In another example, the present application describes a system. The system may comprise one or more processors, a light system, and may also include a memory having stored thereon executable instructions that upon execution by the one or more processors cause the system to perform functions. The functions may include detecting a user in a position proximate to an interface of the system. The functions may further include, responsive to detecting the user, determining an area that encompasses the position of the user, and causing the light system to illuminate the determined area using a light handshake. Additionally, in some instances, the light handshake may comprise illuminating a given aspect of the interface of the system and subsequently extending the illumination in a visual presentation from the given aspect of the interface of the system to encompass the position of the user.

In an additional example, the present application describes a non-transitory computer readable medium having stored thereon executable instructions that, upon execution by a computing device, cause the computing device to perform functions. The functions may comprise detecting a user in a position proximate to an interface of the computing device, and responsive to detecting the user, determining an area that encompasses the position of the user. The functions may also include causing a light system to illuminate the determined area using a light handshake, wherein the light handshake comprises illuminating a given aspect of the interface of the computing device and subsequently extending the illumination in a visual presentation from the given aspect of the interface of the computing device to encompass the position of the user.

In another example, a system is provided that comprises a means for wireless control of one or more robotic devices. The system may include means for detecting a user in a position proximate to an interface of the system. The system may further include, responsive to detecting the user, means for determining an area that encompasses the position of the user. The system may also include means for causing a light system to illuminate the determined area using a light handshake. In some instances, the light handshake comprises illuminating a given aspect of the interface of the computing device and subsequently extending the illumination in a visual presentation from the given aspect of the interface of the computing device to encompass the position of the user.

The foregoing summary is illustrative only and is not intended to be in any way limiting. In addition to the illustrative aspects, embodiments, and features described above, further aspects, embodiments, and features will become apparent by reference to the figures and the following detailed description.

DETAILED DESCRIPTION

Figure 1A:
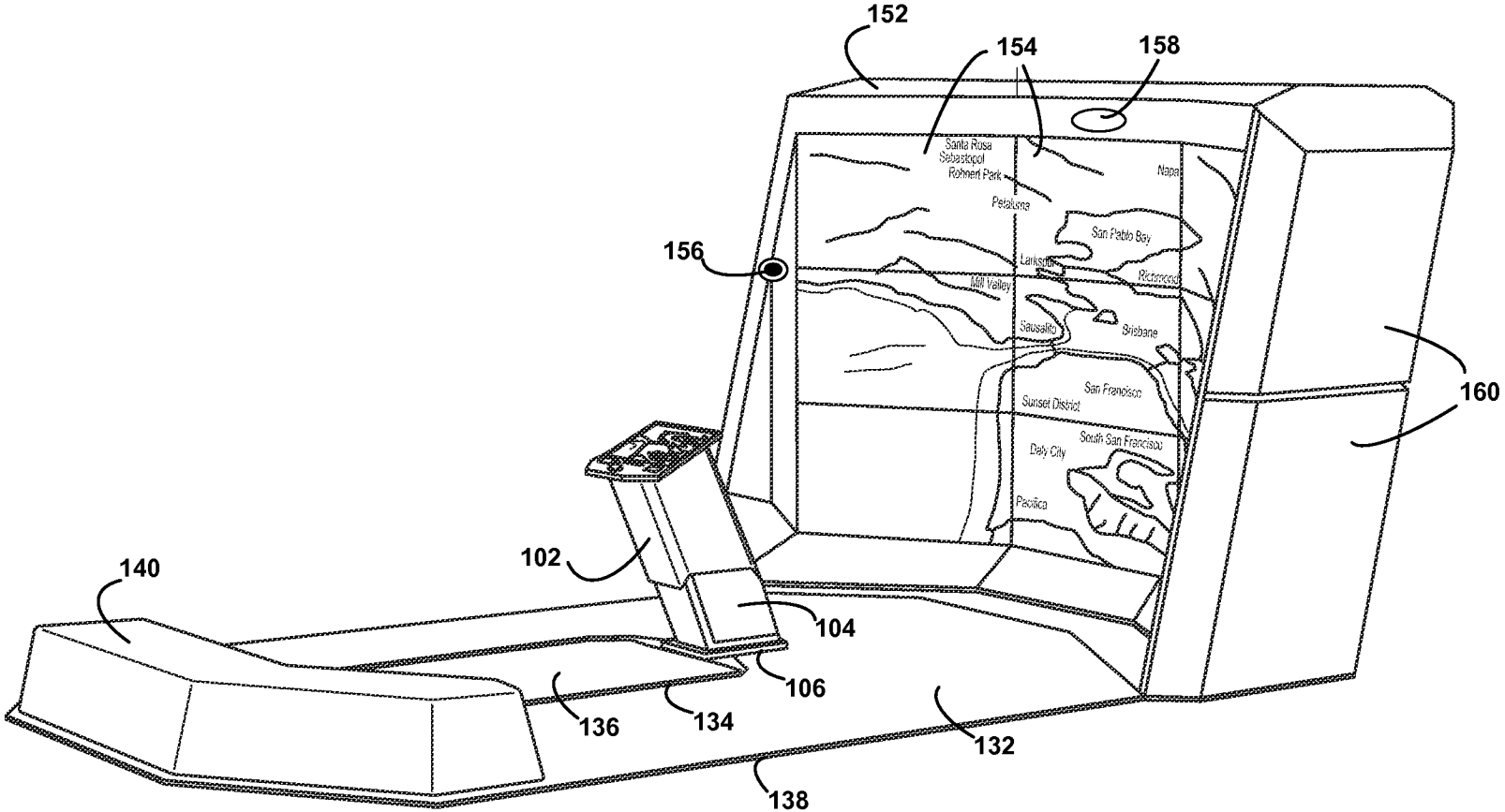
FIG. 1A shows a view of an interactive display system, according to an example embodiment.

Example methods and systems are described herein. Any example embodiment or feature described herein is not necessarily to be construed as preferred or advantageous over other embodiments or features. The example embodiments described herein are not meant to be limiting. It will be readily understood that certain aspects of the disclosed systems and methods can be arranged and combined in a wide variety of different configurations, all of which are contemplated herein.

Furthermore, the particular arrangements shown in the Figures should not be viewed as limiting. It should be understood that other embodiments might include more or less of each element shown in a given Figure. Further, some of the illustrated elements may be combined or omitted. Yet further, an example embodiment may include elements that are not illustrated in the Figures.

A computing system often enables a user to control operations through the use of various types of interfaces. For instance, a system may include a touch screen, physical buttons, microphone, or other types of interfaces that enable user input. During operation, a system may also provide alerts to convey information to the user. Example alerts include audio signals, such as beeps or other sound effects, and visual messages.

To further enhance the experience of a user, an example interactive system may use light to further engage a user and relay information to the user. In particular, the interactive system may cause a light system to provide lighting or illumination in certain ways, also described herein as an interactive lighting handshake or lighting handshake, to relay information to users. By executing an interactive lighting handshake, the interactive system may convey operation information to the user in a visual way that may make the user feel connected or "plugged in" to the interactive system. As such, the interactive system may perform one or more interactive lighting handshakes to further enhance the user's experience using the interactive system.

In some instances, an example interactive system may use a lighting handshake to inform that an interface is available for control. For instance, the interactive system may illuminate the interface using LEDs or a beam of light. As such, the system may further enhance the visual presentation by illuminating the interface and transitioning the illumination from the interface towards the user until encompassing the position of the user. Similarly, the interactive system may illuminate lights positioned on the ground, such as strips of LEDs, between the position of the user and the interface. This runway of lights may serve as a visual presentation that informs the user that the particular interface is available for operation.

In another example implementation, an interactive system may use a lighting handshake to initially welcome a user or users. In particular, based on detecting the presence of a user relative to an interface or other aspect of the interactive system, the system may determine and illuminate an area that encompasses the user. This illumination may involve the use of various types of lights, such as LEDs placed on the ground or beams of light. As such, the interactive system may initially light up an aspect of the interactive system, such as a podium, and extend the illumination to further include the area of the user in addition to the podium. In other instances, the interactive system may illuminate the aspect of the interactive system and gradually move the illumination towards the user instead of simply increasing the area of illumination. The movement of illumination may visually convey information to the user, such as informing the user that the aspect of the interactive system serves as a control interface for the user to manipulate.

In some examples, an interactive system may use lighting handshakes to convey the boundaries associated with using the interactive system. For instance, the interactive system may illuminate boundaries to show a user the available area for operating within the interactive system. Similarly, in response to detecting movement of a user, the interactive system may turn off or change colors of lights to inform the user when she is no longer in an operation position within the system. Likewise, the interactive lighting system may manipulate light beams to cause the light to appear bending around the user to inform the user that she is leaving the control area, for instance. As the user continues to change position, the interactive lighting system may cause the light to appear to break when the user crosses the boundary. In other examples, the interactive system may cause a line of light to stretch and fade away as the user walks away from the interactive system.

The interactive system may adjust parameters associated with interactive lighting handshakes. For instance, the system may adjust the brightness, colors, timing, consistency, and/or types of lights associated with implementing an interactive lighting handshake. Likewise, the interactive system may adjust triggers that cause the initiation of a lighting handshake. Further, the interactive system may also further enhance an interactive lighting handshake by adding one or more audio, visual, and/or vibration signals. As one possible example, an interactive system may play background music or audio alerts in addition to an interactive lighting handshake. Other examples of using other effects during interactive lighting handshakes may exist.

Reference will now be made in detail to various embodiments, examples of which are illustrated in the accompanying drawings. In the following detailed description, numerous specific details are set forth in order to provide a thorough understanding of the present disclosure and the described embodiments. However, the present disclosure may be practiced without these specific details. In other instances, well-known methods, procedures, components, and circuits have not been described in detail so as not to unnecessarily obscure aspects of the embodiments.

Example embodiments involve a system that provides an interactive user experience through a variety of possible input and output devices. A number of different possible types of user experiences may be created using the systems and methods described herein, including applications in navigation, gaming, product demonstration, and web searching. For illustration purposes, some figures and examples are described in the context of navigation around the Earth or a different physical environment. Numerous other applications are also possible.

Additionally, certain types of input devices and output devices are described as part of an illustrative example system, but the system may not include every type of device or interface described or illustrated, and may also include one or more types of devices or interfaces not explicitly shown. Any or all of the components described and illustrated could be placed in different arrangements, combined, or separated in different ways as well.

Figure 1B:
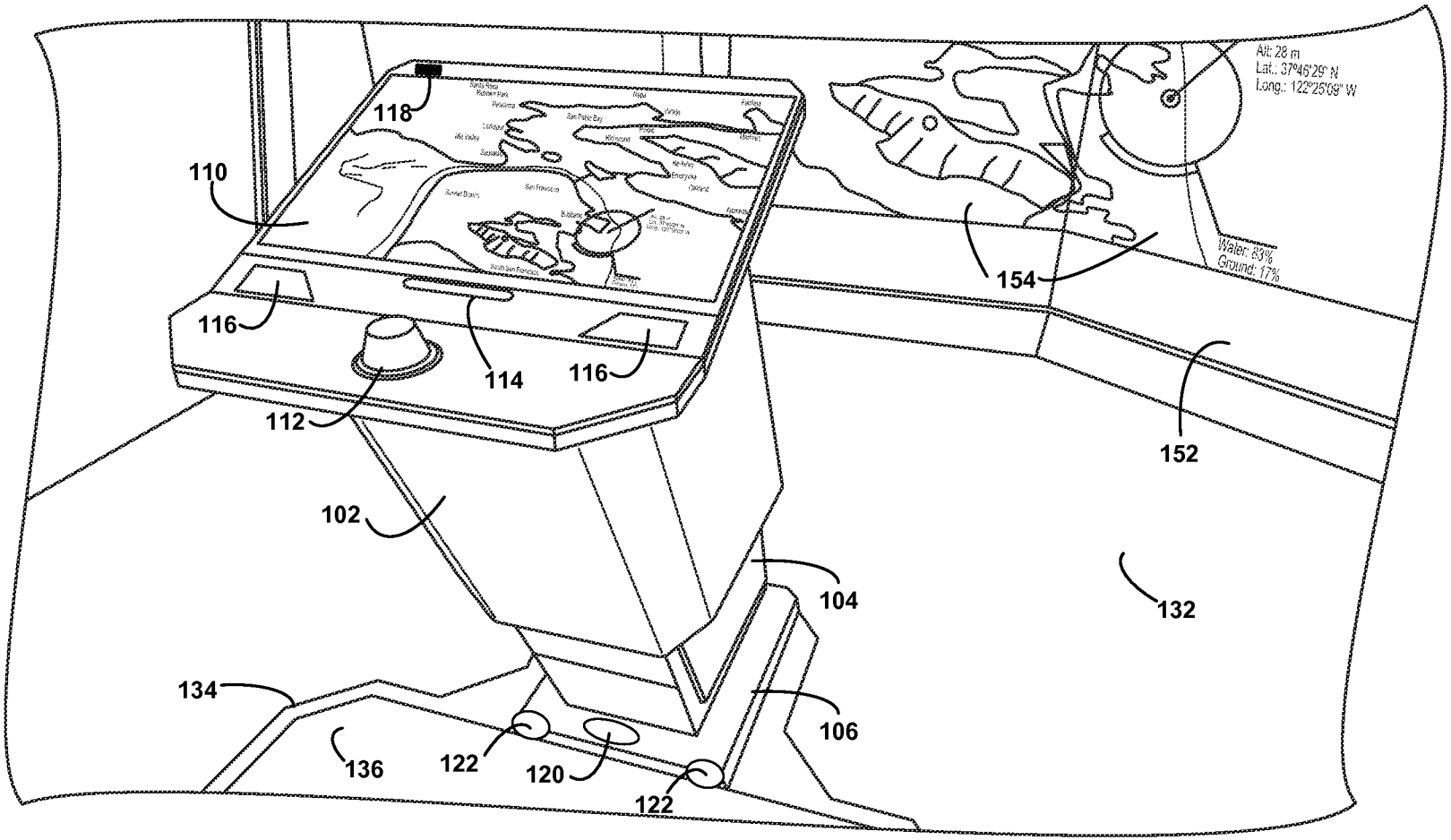
FIG. 1B shows another view of an interactive display system, according to an example embodiment.
Figure 1C:
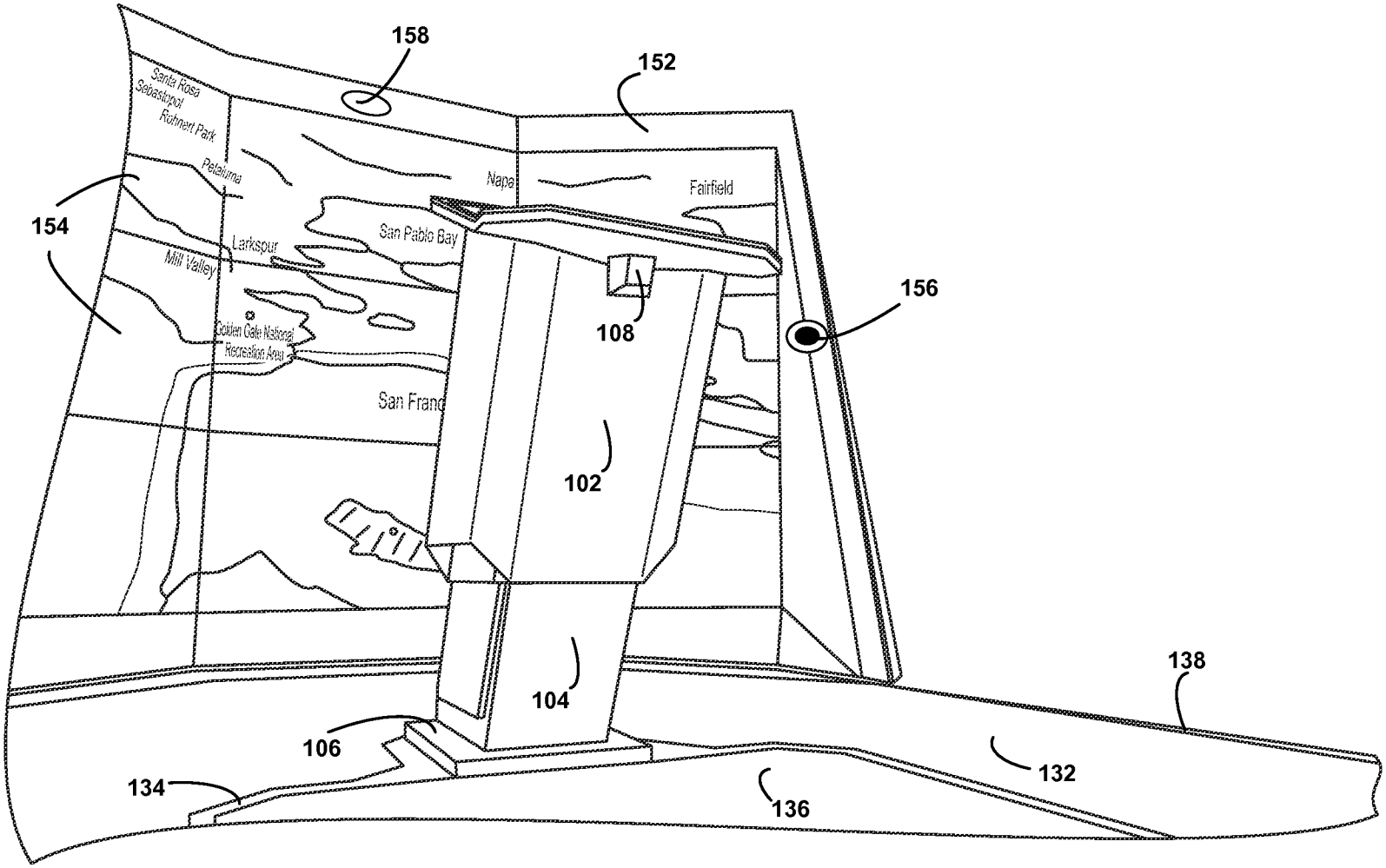
FIG. 1C shows a further view of an interactive display system, according to an example embodiment.
Figure 1D:
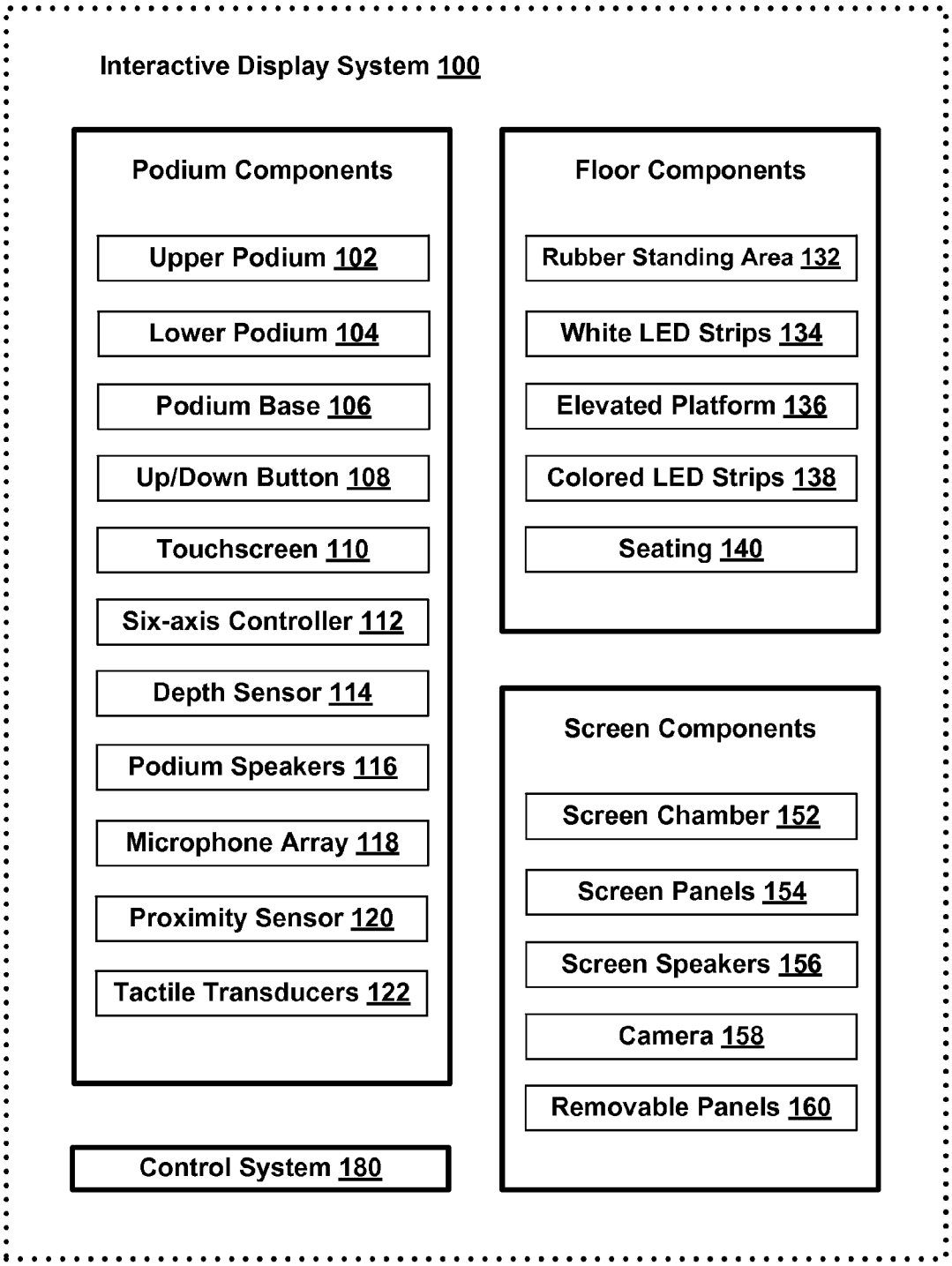
FIG. 1D is a functional block diagram illustrating components of an interactive display system, according to an example embodiment.

FIGS. 1A, 1B, and 1C illustrate different views of an interactive display system, according to example embodiments. Additionally, FIG. 1D is a functional block diagram illustrating components of an example interactive display system. As shown in FIG. 1D, the components may generally be divided into a first group of components positioned on or within a podium that allows for user interaction, a second group of components positioned on or within a floor section on which the podium is placed, and a third group of components positioned on or within a large screen in front of the podium. In other examples, some of the components could be included in a different group and/or positioned elsewhere within the system.

As illustrated in FIGS. 1A, 1B, and 1C, a podium may include a variety of different types of input and/or output components to facilitate interaction with a user standing in front of the podium. Additionally, other example implementations may include more than one podium, which may enable multiple users to operate aspects of the system from individual podiums. As shown in FIG. 1A, the podium includes an upper podium 102 and a lower podium 104. In particular, the upper podium 102 may be configured to slide or otherwise move up and down relative to the lower podium 104. For instance, an up/down control button 108 may permit the upper podium 102 to be moved up or down when the control button 108 is pressed. Within examples, the height of the podium can be adjusted to accommodate users of different heights. In some cases, the system may detect the presence of a user in front of the podium and automatically adjust the height of upper podium 102 to accommodate the user. For instance, the system may use sensor information to adjust the properties of the podium according to the particular user present. The shape and/or size of the podium may be varied from the examples illustrated within FIGS. 1A, 1B, and 1C.

As shown in FIG. 1A, lower podium 104 is attached to podium base 106. The podium base 106 may serve as an entity that enables rotation of the podium to accommodate people who are not standing directly in front of the podium. In some examples, the system may detect a person nearby and automatically rotate the podium using podium base 106 in order to align the podium with the person to allow the person to interact with one or more interfaces on the podium. In another example, the podium base 106 may be capable of a 180 degree turn so that the podium faces away from the big screen. Such a configuration may allow the podium to serve as a lectern for a person to give a speech with the big screen providing audiovisual content for a presentation.

The podium may include a number of different types of interactive elements (e.g., interfaces) to allow a user to provide instructions or input to the system and/or to allow the system to provide feedback or output back to the user. In an example system, one or more components are placed on a top surface of upper podium 102. The top surface of upper podium 102 may be aligned at an angle (e.g., 25 degrees from horizontal) that facilitates interaction with the components by a user standing in front of the podium. In further examples, some or all of the components may be positioned elsewhere on the podium.

In some examples, the podium includes a touchscreen 110, an electronic visual display that may be controlled by a user who touches the screen with one or more fingers or an object such as a stylus. In some examples, the images displayed on touchscreen 110 may mimic the images displayed on the big screen in front of the podium. Accordingly, the system allows a user to stay oriented when moving her eyes between looking at the touchscreen 110 on the podium and the big screen in front of the podium. For instance, as shown in FIGS. 1A, 1B, and 1C, both the touchscreen 110 and the big screen may show the same view of the Earth along with the same graphical user interface elements. The touchscreen 110 may allow users to change the images displayed on both screens through touch input, for example, to navigate around the Earth or to select particular areas on the Earth to display more information.

In further examples, the podium additionally includes a six-axis controller 112, as shown in FIG. 1B, which may be used to control what is displayed on the big screen in front of the podium. For instance, the six-axis controller 112 may allow a user to navigate around the Earth by controlling different degrees of freedom of a view shown on the screen (e.g., simulating motion of a camera). Pulling up or pushing down on the controller 112 may cause the view to translate in a direction parallel to the view (e.g., to cause a view of the Earth to zoom in or zoom out). Moving the controller 112 left, right, forward, or backward may cause the view to pan left, right, up, or down. Additionally, tilting the controller 112 forward or backward may cause the view to tilt forward or backward. Further, spinning the controller 112 left or right (e.g., a steering wheel turn) may cause the view to rotate in the same direction. Also, tilting the controller 112 left or right may cause the view to tilt left or right. In some examples, the view may not be allowed to tilt left or right, in which case only the other five degrees of freedom may be controlled by the controller 112. Depending on the application, the different possible motions of the controller 112 may have different effects on the output displayed on the big screen as well.

In additional examples, the podium includes a depth sensor 114, which may detect movements of a user's hands or fingers over the depth sensor 114. In some examples, the system may use data from the depth sensor 114 to identify movements (e.g., translations or rotations) of a user's hand as a single object. The movements may then be used to control some aspect displayed on the big screen. In further examples, the system may also use data from the depth sensor 114 to identify certain gestures such as a hand flick, hand waving, or finger pointing. These actions by the user may control different aspects of the presentation on the screen.

In some examples, the depth sensor 114 may generate a hover signal to indicate when a user is hovering her hand over the depth sensor 114. Additionally, the depth sensor 114 may be positioned relative to the touchscreen 110 such that data from the depth sensor 114 indicates where a user is hovering her hand over the touchscreen 110. Accordingly, movements of a user's hand over an image on the touchscreen 110 may produce a visual effect at the same location of the image on the big screen in front of the podium. In some examples, the hover signal may be used to control a heads-up display (HUD) window overlaid on a portion of the screen. The user may control the size and/or location of the HUD window by moving her hand (e.g., increasing the area covered by the HUD window by moving her hand further from the depth sensor). In some examples, the HUD window may allow the user to visualize certain pieces of data corresponding to the area covered by the HUD window (e.g., the population within the area).

In further examples, the podium may include one or more speakers 116, which may be used by the system to send audio feedback to the user. For instance, the speakers 116 may produce sound indicative of movement when a person uses the six-axis controller 112 to change the view on the big screen (e.g., to navigate around the Earth). In other examples, sound from the speakers 116 may be coordinated with user input actions on the touchscreen 110 and/or the depth sensor 114 as well or instead.

In additional examples, the podium may include a microphone array 118, which may detect audio signals. The microphone array 118 may allow the system to detect and process vocal commands from the user. For instance, a user may give the system a voice command through the microphone array 118 to change the view on the big screen, ask for instructions, or switch to a new application. In some examples, the microphone array 118 may also allow a user to engage in a video conference call with another person displayed on the big screen.

In further examples, the podium may include a proximity sensor 120. The proximity sensor 120 may be positioned on the front side of the podium (e.g., at or near the base) in order to detect the presence of a person in front of the podium. In some examples, one or more interactive features may be activated when the proximity sensor 120 detects a user in front of the podium. For instance, the touchscreen 110 may automatically turn on in order to enable the user to begin interacting with the system. In additional examples, one or more features may also be deactivated when the proximity sensor 120 detects that a user has moved away from the podium.

In further examples, the podium may include one or more tactile transducers 122 positioned at or near the base of the podium to produce signals at frequencies that can be felt by a user standing in front of the podium. In some cases, two tactile transducers 122 can be positioned on either side of the podium in order to produce signals felt separately by a user's left foot and right foot. For instance, in an example application where a user is maneuvering the six-axis controller 112 to navigate around the Earth on the big screen, the tactile transducers 122 may be used to produce haptic effects that make the user feel like he is flying (e.g., a rumbling effect may be produced when the user is navigating rapidly through the environment).

Interactive display system 100 may additionally include one or more components positioned on the floor around the podium in front of the big screen. These components may facilitate an interactive experience between the system and a person standing in front of the podium and/or one or more other people nearby. In some cases, the components of the floor may be designed so that the entire system can be quickly installed in different locations without requiring additional infrastructure in each location.

In some examples, the floor may include a rubber standing area 132 that extends out from the big screen and encompasses the podium. The standing area 132 may demarcate a section in which people can see visual effects on the big screen or experience other aspects of an interactive experience. The standing area 132 may additionally include an incline ramp around the edge for accessibility.

In further examples, the floor may also include white LED strips 134 which extend from the podium to surround an area in front of the podium. The white LED strips 134 may indicate to a user where to stand in order to operate controls on the podium and/or to experience other aspects of the system. In some examples, the white LED strips 134 may light up when a user enters the area of the floor encompassed by the LED strips in order to indicate that the user is connected to the system. For instance, the white LED strips 134 may illuminate based on sensor data from the proximity sensor 120 indicating that a person has entered the space in front of the podium.

In additional examples, the floor may include an elevated platform 136 positioned in front of the podium, which may optionally be surrounded by the white LED strips 134. The elevated platform 136 may allow for vibration of the platform 136 without affecting the surrounding rubber standing area 132. Accordingly, the tactile transducers 122 may be used to provide targeted haptic effects to a user standing on the elevated platform 136 that may only be felt by the user.

The floor may also include colored LED strips 138 wrapped around the rubber standing area 132. The colored LED strips 138 may help to segment the entire system from the surrounding environment. In some examples, colors on the LED strips 138 may be changed to correspond to different aspects of the interactive experience. In additional examples, the other components of the system such as the podium and the chamber for the big screen may be white, which may provide a visual effect of color flowing around a white base.

The floor may additionally including seating 140 to allow other people to experience aspects of a presentation in addition to the person at the podium. In some examples, certain effects (e.g., vibration from elevated platform 136) may only be experienced by a person at the podium, while other effects (e.g., images on the big screen) may be experienced by people sitting on the seating 140. The seating 140 could also be easily removable fixtures to allow the system to adapt to different types of applications or environments.

Interactive display system 100 may additionally include a screen positioned in front of the podium for display of visual content, such as a view of the Earth. A user may be able to control the view on the screen and/or the information displayed on the screen through one or more input mechanisms, such as the touchscreen 110, the six-axis controller 112, or the depth sensor 114 on the podium. An example arrangement of the podium and big screen is illustrated in FIGS. 1A, 1B, and 1C, but the podium and screen may have different sizes, shapes, or relative positioning in other examples as well.

The big screen in front of the podium may include a screen chamber 152 which houses a number of different screen panels 154. For instance, in one example, the chamber 152 may house nine 55-inch screen panels 154 arranged in a three by three grid. The chamber 152 may be shaped to allow for a 30 degree angle between horizontally contiguous screen panels. This arrangement may allow a user to visualize a larger field of view than a flat arrangement of screen panels without wrapping too far around a user's peripheral, which may disorient the user. In some example applications, each of the screen panels 154 may display a different section of a single view (e.g., the view of the Earth from a single viewpoint). In other applications, one or more of the screen panels 154 may display different views and/or different types of content as well.

In further examples, the screen chamber 152 may include one or more screen speakers 156 to provide audio content to a user. In one example, the screen chamber 152 may house left and right speakers 156, which could provide targeted audio signals toward a user standing in front of the podium. In other examples, the speakers 156 could provide some or all of the audio content to anybody standing within the rubber standing area 132 as well.

In additional examples, the screen chamber 152 may also include a camera 158 positioned above the screen panels 154. The camera 158 may be directed towards the podium to enable a user standing at the podium to engage in a video conference call. For instance, a user at the podium may be able to speak to another person displayed on one or more of the screen panels 154 while video of the user is captured by camera 158 and audio is captured using the microphone array 118 on the podium.

In some examples, the screen chamber 152 may include one or more removable panels 160, including side and/or rear panels. By employing removable panels, the system may be easily adapted to different applications and/or to different types of environments. For instance, the side panels may only be used in areas with other displays nearby, so that visual or audio content from the system does not disrupt the other displays. The screen chamber 152 may be shaped or constructed in other ways as well.

Interactive display system 100 may also include control system 180, which may provide instructions to one or more of the other components of the system. For instance, control system 180 may process data received from one or more input devices and determine responsive output to be produced by one or more output devices. Control system 180 may include at least one processor (which could include at least one microprocessor) that executes instructions stored in a non-transitory computer readable medium. Control system 180 may also represent a plurality of computing devices that may serve to control individual components or subsystems of interactive display system 100 in a distributed fashion. For instance, any of the input and output devices of the system may have their own local control systems, which could optionally serve as master control systems for other devices. Control system 180 could also include one or more remote computing systems that communicate control instructions to one or more components of the system. The control functions of control system 180 could be distributed in other ways as well.

Figure 2:
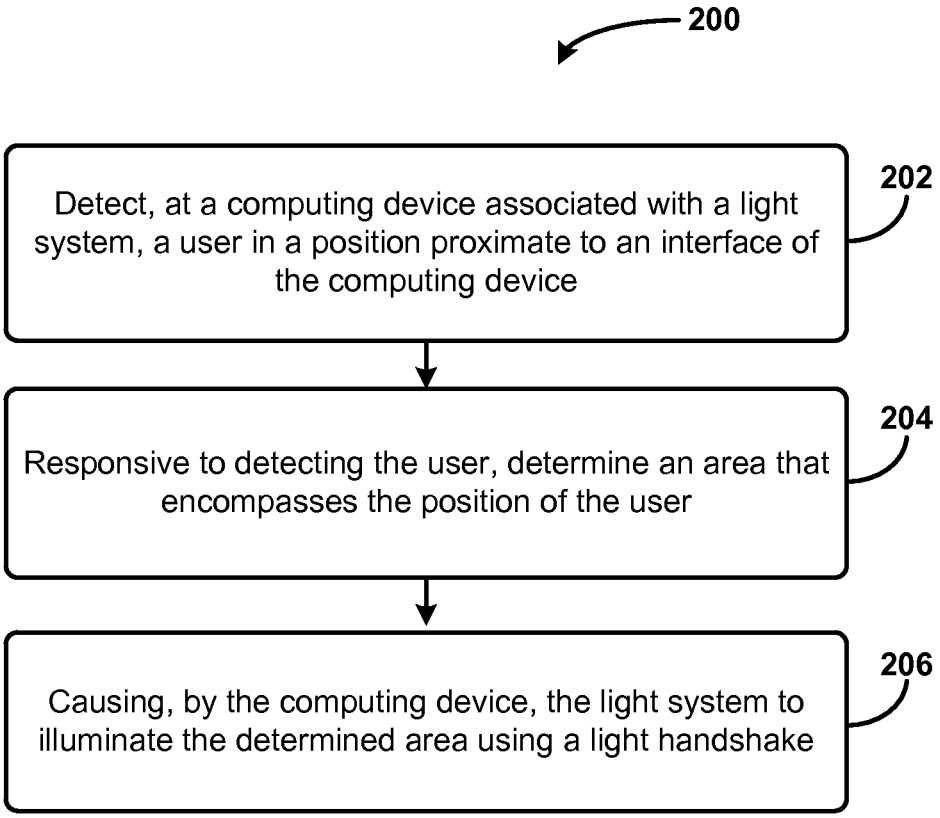
FIG. 2 is a flowchart for implementing an interactive lighting handshake, according to an example embodiment.

FIG. 2 is a flowchart for implementing an interactive lighting handshake, according to an example embodiment. The flowchart 200 may include one or more operations, or actions as illustrated by one or more blocks 202-206. Although the blocks are illustrated in a sequential order, these blocks may, in some instances, be performed in parallel, and/or in a different order than those described herein. Also, the various blocks may be combined into fewer blocks, divided into additional blocks, and/or removed based upon the desired implementation.

Additionally, the flow chart may further show functionality and operation of possible implementations of present implementations. In this regard, each block may represent a module, a segment, or a portion of program code, which includes one or more instructions executable by a processor for implementing specific logical functions or steps in the process. The program code may be stored on any type of computer readable medium or memory, for example, such as a storage device including a disk or hard drive. The computer readable medium may include a non-transitory computer readable medium, for example, such as computer-readable media that stores data for short periods of time like register memory, processor cache and Random Access Memory (RAM).

The computer readable medium may also include non-transitory media or memory, such as secondary or persistent long term storage, like read only memory (ROM), optical or magnetic disks, compact-disc read only memory (CD-ROM), for example. The computer readable media may also include any other volatile or non-volatile storage system. The computer readable medium may be considered a computer readable storage medium, a tangible storage device, or other article of manufacture, for example.

The non-transitory computer readable medium could also be distributed among multiple data storage elements, which could be remotely located from each other. A computing device or control system that executes some or all of the stored instructions could be any type of computing device, such as the example computing device 100 shown in FIG. 1, respectively. Alternatively, the computing device or system that executes some or all of the stored instructions could be another computing device or system, such as a server. In addition, each block in FIG. 5 may represent circuitry that is wired to perform the specific logical functions in the process.

Different types of computing devices may execute method 200 or similar methods. For example, method 200 may be carried out using an interactive display system, such as illustrated and described with respect to FIGS. 1A, 1B, 1C, and 1D. In some examples, method 200 may be executed by a control system of such a system, such as control system 180 as described with respect to FIG. 1D.

At block 202, method 200 may include detecting, at a computing device associated with a light system, a user in a position proximate to an interface of the computing device. An interactive system performing method 200 or similar methods may utilize information provided by one or more sensors to determine information about one or more users. For instance, the interactive system may receive sensor data from motion sensors, cameras, scales, proximity sensors, contact sensors, and/or other types of sensors associated with the system. In some instances, the interactive system may use sensor information to detect the presence of a user relative to a component or interface of the interactive system.

Further, in some implementations, an example interactive system may use sensor data to determine a variety of parameters associated with a user or users prior to implementing an interactive lighting handshake. For instance, the interactive system may determine whether or not a user is holding a particular component prior to executing an interactive lighting handshake. Likewise, the interactive system may receive information indicating that the user is providing inputs via an interface (e.g., pushing buttons or the touchscreen) that may inform the system to perform one or more interactive lighting handshakes.

An interactive system may use sensor information that indicates one or more of the height, weight, orientation, and velocity, etc. of the user. This way, the system may use the sensor information to extract additional information that may increase the accuracy of an interactive lighting handshake. For example, the interactive system may adjust parameters of an lighting handshake based on an orientation and/or position of the user.

In some example implementations, the interactive system may be configured to use sensor information to determine when a user is within a threshold distance from an interface of the system. As such, the system may utilize the sensor information to estimate a proximate distance between the user and the interface. In some examples, the proximate distance requires that the user is in a position close enough to the interface of the interactive system to interact with the interface. For instance, the interactive system may detect the user within a distance from controls of a podium. Further, the threshold distance may vary in examples. For instance, the interactive system may require that the position of the user is within a meter of a podium of a system prior to utilizing an interactive lighting handshake.

In some examples, an interface of the interactive system is a control or input-receiving entity that enables a user or other entity, such as robotic device, to interact with the system. For instance, an interactive system can include buttons, joysticks, touchscreens, microphones, motion sensors, and/or other types of interfaces.

As indicated above, the interactive system may include a light system. The light system, in some examples, is a system that is configured to deliver lights to various aspects of the system. For instance, the light system may include spot lights and/or LEDs positioned at various locations in the interactive system.

At block 204, method 200 may further include responsive to detecting the user, determining an area that encompasses the position of the user. After detecting the presence of a user or multiple users, an example interactive system performing method 200 or similar methods may determine further information regarding the users prior to executing an interactive handshake. For instance, an interactive system may estimate a position of users relative to boundaries of the system or relative to components within the system.

In some instances, the interactive system may determine an area or multiple areas that encompass a user or users. For example, the interactive system may estimate an area that encompasses a portion or the entire user. As indicated, the size of the area determined by the interactive system may vary in examples. The area may reflect the size of the user or may extend to encompass the user as well as extra space surrounding the user.

Additionally, in some instances, the interactive system may determine an area in different shapes. For instance, the interactive system may determine a symmetrical or nonsymmetrical area. Likewise, the computing device may further determine different shapes for illuminating, such as rectangular, circular, or other types of areas.

Further, the interactive system may be configured to determine two-dimensional (2D) area or three-dimensional (3D) volume. For example, the interactive system may be configured to determine a volume that includes a base positioned around the user as well as a height that encompasses the height of the user.

At block 206, method 200 may include causing, by the computing device, the light system to illuminate the determined area using a light handshake. At this point, a computing device, such as the control system of the interactive system, may utilize one or more lights of a lighting system to perform an interactive light handshake in response to determining an area that includes a user or users. As previously indicated, the interactive system may execute a light handshake to convey information to the user and/or enhance the overall experience of using the interactive system. Various lights and visual presentations associated with a light handshake may cause the user to feel more engaged.

In some examples, a light handshake involves a light system of the interactive system providing lights upon determined areas within the interactive system. For instance, the light system may provide beams of light on an area compassing one or more users. Additionally, in other examples, a light handshake involves illuminating one or more ground lights (e.g., strips of LEDs) positioned nearby components of the interactive system and/or users. As such, the light handshake, for instance, involves first illuminating ground lights positioned by an interface of the interactive system and subsequently illuminating ground lights positioned in between the interface and the position of the users until illuminating ground lights positioned under the users. In other examples, a light handshake involves illuminating multiple types of lights.

Responsive to determining the area that includes the user or users, the interactive system may use different lights within a lighting system that can execute the lighting handshake. As such, the light system may perform a light handshake in various ways. In particular, the examples described herein represent only a few of the possible interactive lighting handshakes that the interactive system may use.

During operation, the choice by the control system of the interactive system to use a particular light handshake or multiple light handshakes may depend on a variety of factors. For instance, the interactive system may adjust parameters associated with a given light handshake based on the position of the user and/or the inputs that the user is providing to the computing device via one or more interfaces.

In an example implementation of an interactive lighting handshake, an interactive system may perform the handshake by illuminating a given aspect of an interface or component of the system positioned nearby the user. For instance, the lighting system may shine a beam of light (e.g., spotlight) upon the interface or component. Similarly, the lighting system may illuminate lights, such as LEDs) positioned within the interface. In some cases, the interactive system may use a combination of multiple types of lights to initiate the lighting handshake.

After the initial illumination, the interactive system may extend the illumination in a visual presentation to further encompass the determined area that includes the position of the user. Likewise, the visual presentation may involve gradually illuminating the area between the interface and the determined area until reaching the determined area. This way, the user may perceive that the light extends from the interface towards her.

Additionally, an interactive system may adjust parameters associated with executing a light handshake to further relay information to the user. For instance, the interactive system may cause the light system to use color lights or adjusted levels of brightness to signal a variety of information. In an example illustration, an interactive lighting system may use green or white light to indicate that a position or inputs of a user are proper and may also use red light to indicate when the position or inputs of the user are improper.

In addition, in some example implementations, the interactive system may further enhance the performance of an interactive lighting handshake by adding one or more additional types of signals, such as audio, visual, or vibrational signals. For instance, the interactive system may perform audio effects or music in addition to performing the lighting handshake. As one example illustration, the interactive system may start and stop sound effects in accordance with the duration of performing a lighting handshake. This way, the interactive system may compliment the visual effects of the lighting handshake with audio effects that may further cause the user to feel engaged with the interactive system.

Likewise, the interactive system may cause the area below a user to vibrate or a component to vibrate or move to further enhance the experience of the user during the lighting handshake. For instance, the interactive system may vibrate the ground under the user prior to conducting a lighting handshake to prepare the users for the interactive lighting handshake. The interactive system may provide visual messages or other visual effects in addition to the illuminations associated with a lighting handshake. In some instances, an example interactive system may display visual messages on a screen to convey information that enhances the experience of the user in addition to the use of interactive lighting handshakes. The additional signals may further engage the user and enhance the overall experience associated with lighting handshakes and the interactive system.

Further, in some instances, the interactive system may use particular signals or lighting handshakes based on the position of the user, the size of the determined area, the number of users, the interface at which the user is interacting, and/or other possible factors. The interactive system may also include configurations that enable a user to program and select particular lighting handshakes or effects.

In some example implementations, an interactive system may utilize a light handshake that primarily involves illuminating one or more light emitting diodes (LEDs) positioned relative to the position of the user. For instance, a control system of the interactive system may cause the illumination of one or more LEDs placed on the ground around the position of the user in some formation, such as a circle of LEDs that encompasses the user.

In some implementations, the interactive system may use multiple interactive light handshakes in some situations. For example, the interactive system may illuminate aspects of the system using a light beam in response to detecting the presence of the user relative to the aspects of the system. After illuminating the aspects of the system using the light beam, the interactive system may switch to and/or add an additional light handshake to further relay information to the user. For instance, the interactive system may then cause the light system to illuminate one or more LEDs positioned within the given aspect of the component and/or positioned on the ground around the position of the user in response to receiving one or more inputs from the user. This way, the interactive system may inform the user that the computing device is receiving the inputs provided by the user and further enhance the experience of the user.

The interactive system may be further configured to detect changes in the position or movement of the user or users and adjust one or more parameters of a given light handshake based on the changes. In some instances, the interactive system may cause the light system to change the light handshake to illuminate the new position of the user. Additionally, the interactive system may cause the light system to adjust the brightness, color, and/or other parameters associated with the light handshake in response to detected changes.

Further, the method 200 or similar methods may involve the interaction system detecting a change in the position of the user above a threshold and causing the light system to stop illuminating the position of the user. Additionally, the interactive system may subsequently stop illuminating the given aspect of the interface in response to detecting the user change position by at least a threshold distance. Similarly, the interactive system may detect a change or motion of a user and adjust one or more applications of lights in response. For instance, the control system may cause a light beam to bend around the user to indicate a boundary associated with operating the interactive system.

Similar to using one or more light handshakes as well as other possible signals to relay information to a user to enhance the experience of the user, the interactive system may also stop a light handshake and/or other signals to provide information to the user. In some instances, the interactive system may detect that the position of the user has changed and may stop the light handshake in response. For example, the interactive system may detect, based on sensor information, that a user is no longer positioned nearby a control interface associated with the computing device. In response, the interactive system may adjust one or more parameters associated with the performance of a lighting handshake (as well as other possible signals). Further, the interactive system can disconnect a lighting handshake in response to specific user inputs. For instance, the interactive system may disconnect and stop or transition to a new lighting handshake upon receiving a voice command or detecting the input of a disconnect connect button by a user.

An interactive system may be further configured to initiate a timer in response to detecting a user moving off a platform or away from a component of the system. For instance, the interactive system may receive sensor information indicating that the user has moved away from the interactive system and responsively start a timer. The interactive system may be further configured to stop a lighting handshake in response to determining that the timer has expired and may be further configured to resume initiate a new lighting handshake in response to determining that the user has moved back to a position within the interactive system, for example.

In another example implementation, an interactive system may use an input via the six-axis controller or touchscreen that corresponds to a signal for the system to convey information through an interactive lighting handshake. In particular, the system may detect the input and illuminate the interface, an aspect of the screen, and/or other use other forms of lights. For instance, the interactive system may receive a particular input via the six-axis controller and illuminate green or white LEDs placed on the floor of the system in response. The interactive system may further illuminate red LEDs place on the floor in response to receiving an particular input.

The interactive system may further illuminate lights including lights positioned in components, such as the podium and/or screen, in response to detecting the initial presence of a user. For instance, upon detecting a user approach the podium or screen, the interactive system may illuminate one or more aspects of the system. Further, the interactive system may subsequently perform additional lighting handshakes in the case that another user joins the initial user in the interactive system.

In another example implementation, a robotic device may be configured to perform a lighting handshake in response to detecting the presence of a user nearby. For instance, the robotic device may illuminate lights positioned on the robotic device and extend the illumination using a light beam towards the user. Other examples involving a robotic device as the computing device performing a lighting handshake may exist.

Figure 3A:
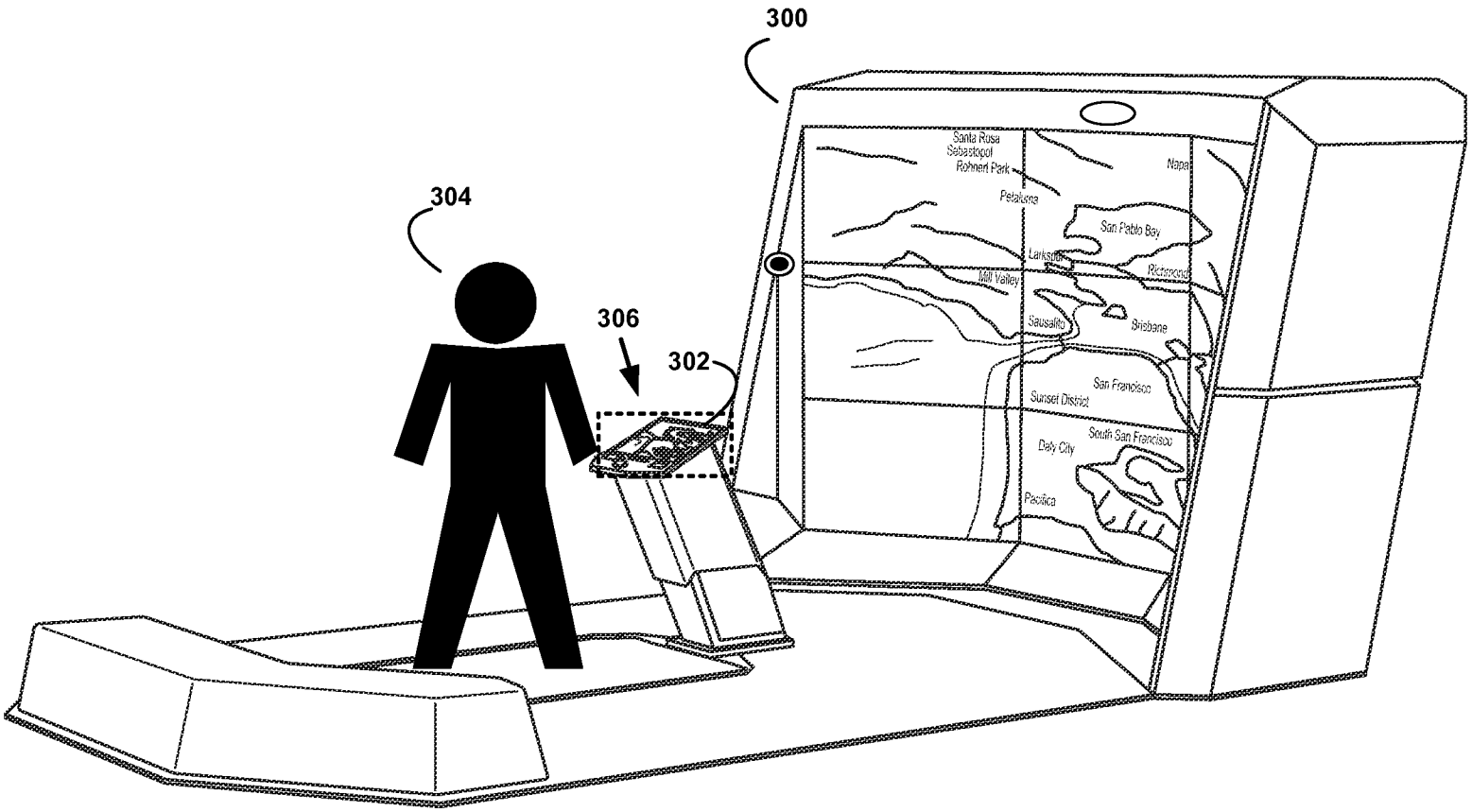
FIG. 3A illustrates an interactive system implementing an initial aspect of an example interactive lighting handshake.

FIG. 3A illustrates an interactive system implementing an initial aspect of an example interactive lighting handshake. As such, the interactive system 300 may correspond to the interactive display system 100 shown in FIGS. 1A-1D or other possible interactive systems. As shown in FIG. 3A, interactive system 300 includes a screen, sensors, and a podium 302 positioned nearby the screen. The podium 302 includes interfaces, such as controls that enable the user 304 to provide inputs to the interactive system 300. In other examples, the interactive system may include more or less components.

In the example implementation illustrated in FIG. 3A, the interactive system 300 is performing an interactive lighting handshake in response to detecting the presence of user 304 in front of the podium 302. As such, as an initial step of the example interactive lighting handshake, the interactive system 300 is illuminating the top area 306 of the podium 302. Illuminating the top area 306 may include illuminating screens, buttons, or other interfaces positioned on the top of the podium 302. In some instances, the podium 302 may include lights positioned on top or within the podium 302.

During operation, the interactive system 300 may illuminate the area 306 on the podium 302 in response to detecting the user 304 based on sensor data. For instance, a control system of the interactive system 300 may receive information from a depth sensor and/or proximity sensor that indicates the presence of the user 304. Similarly, the interactive system 300 may detect an input from controls of the podium 302 that informs the control system about the presence of the user 304. The interactive system 300 may receive inputs via the touchscreen, microphone array, six-axis controller, and/or some other interface. Further, the interactive system 300 may receive an indication about the position and/or presence of the user 304 based on weight measurements performed by a scale positioned nearby the podium 302.

During the performance of the example interactive handshake, the interactive system 300 may utilize colored lights, light flashes, adjust brightness of the lights, and/or other possible parameters associated with lights to further engage the user 304. For example, the interactive system 300 may illuminate a red light in response to receiving a first type of input from user 304 and may further illuminate a green light in response to receiving a second type of input from user 304. As such, the use of the different colors and/or adjusting other parameters of lights during an interactive lighting handshake may convey operation information to the user 304. This may further cause the user 304 to feel engaged with the interactive system 300.

Additionally, interactive system 300 may utilize other signals in addition to implementing the interactive lighting handshake. For instance, interactive system 300 may further include audio alerts or background music along while illuminating the top area 306 of the podium 302. Similarly, interactive system 300 may include vibration alerts or other forms of visual alerts (e.g., messages) in addition to performing the interactive lighting handshake. As an example, interactive system 300 may cause an aspect of the podium or ground nearby the podium to vibrate when illuminating the top area 306 of the podium 302. Likewise, the interactive system 300 may cause a screen on the podium to visually show a message or some other graphic in addition to an interactive lighting handshake.

Figure 3B:
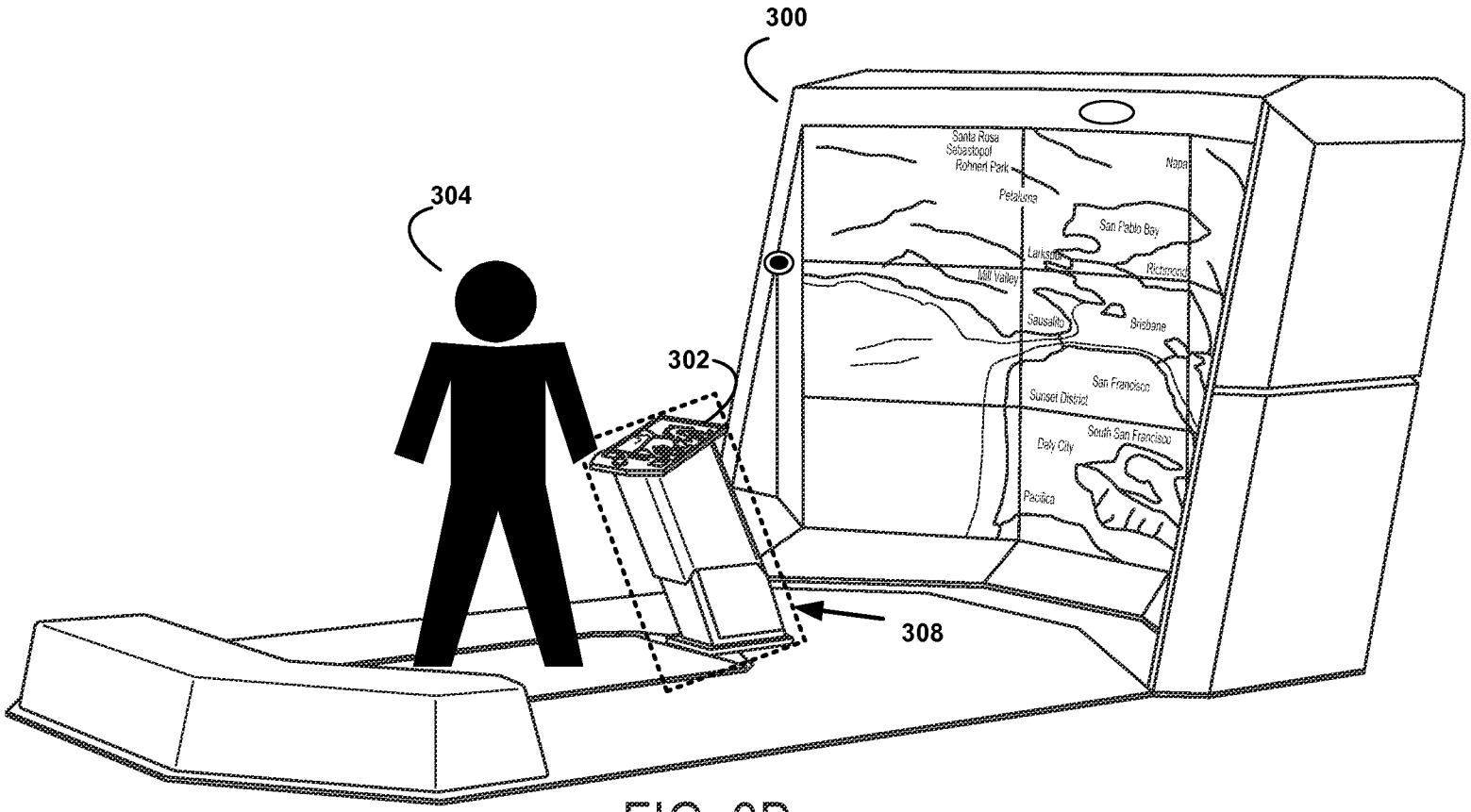
FIG. 3B illustrates the interactive system of FIG. 3A implementing an additional aspect of an example interactive lighting handshake.

FIG. 3B illustrates the interactive system of FIG. 3A implementing an additional aspect of an example interactive lighting handshake. As previously shown in FIG. 3A, the interactive system 300 may illuminate a top portion of podium 302 as an initial element of a lighting handshake in response to detecting an input and/or the presence of the user 304. As such, after illuminating the top portion of the podium 302, the interactive system 300 may further extend the illuminate to include the entire podium as represented by area 308.

Extending the illumination from the top area 306 of the podium 302 to further include the entire podium 302 may involve gradually illuminating the podium 302 from the top area 306 until reaching the bottom area of the podium. Likewise, the interactive system may illuminate the entire podium 302 instantaneously in some example lighting handshakes.

Figure 3C:
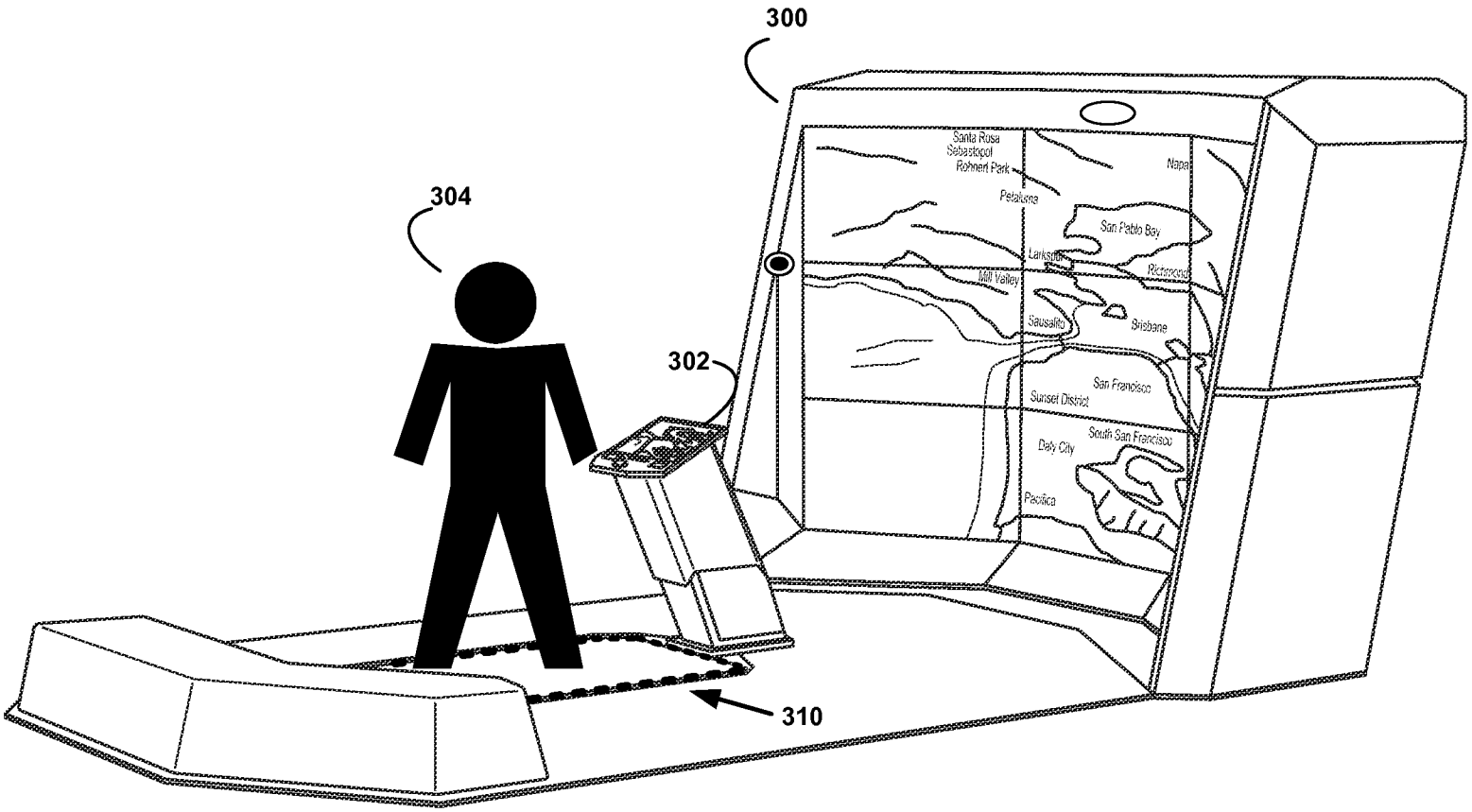
FIG. 3C illustrates the interactive system of FIGS. 3A-3B implementing another aspect of the example interactive lighting handshake.

FIG. 3C illustrates the interactive system of FIGS. 3A-3B implementing another aspect of the example interactive lighting handshake. In particular, FIG. 3C illustrates a further element of a lighting handshake that the interactive system 300 may perform in response to detecting the presence or inputs from the user 304. As such, interactive system 300 is shown illuminating ground lights 310 positioned on the ground nearby the podium 302. In particular, the ground lights 310 illustrated in FIG. 3C are shown positioned around the user 304.

In some examples, the ground lights 310 are strips of LEDs that contain white and/or colored LEDs. As such, the interactive system 300 may illuminate all the ground lights 310 at the same time or may illuminate particular lights within the ground lights 310 in some configuration or order. For example, the interactive system 300 may illuminate ground lights 310 positioned nearby the podium 302 and subsequently illuminate more ground lights 310 extending away from the podium 302. Further, the interactive system 300 may further illuminate the ground lights 310 until the grounds lights 310 encompass the user 304.

In other examples, the interactive system 300 may illuminate the ground lights 310 as the initial step of an interactive lighting handshake. The interactive system 300 may further illuminate the podium 302 and/or other components (e.g., screen) during the duration of the lighting handshake. For example, the interactive system 300 may illuminate the ground lights 310 positioned around the user 304 and subsequently illuminate lights in the base, middle, and/or top portion of the podium 302.

Figure 3D:
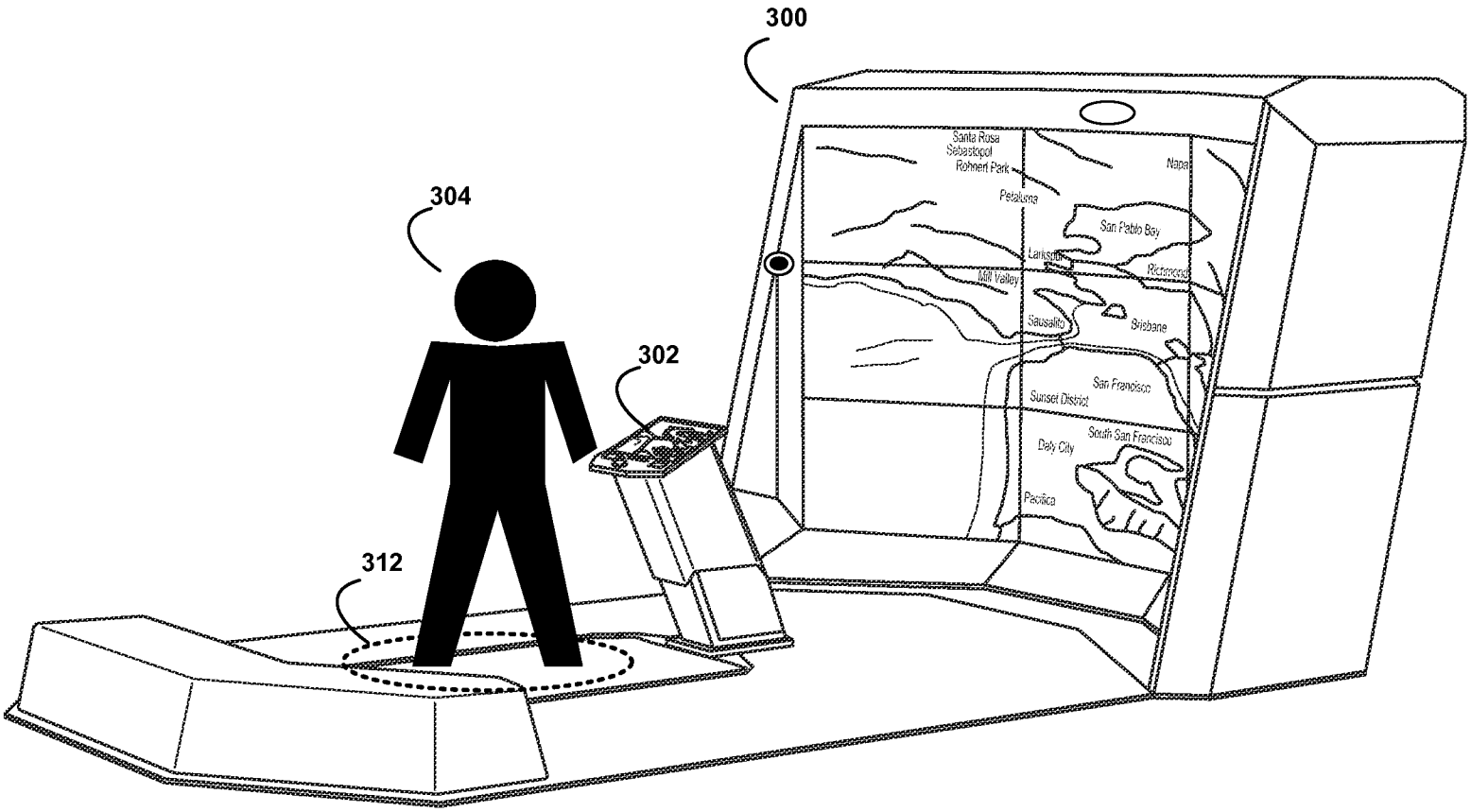
FIG. 3D illustrates the interactive system of FIGS. 3A-3C implementing a further aspect of the example interactive lighting handshake.

FIG. 3D illustrates the interactive system of FIGS. 3A-3C implementing a further aspect of the example interactive lighting handshake. As shown in FIG. 3D, the interactive system 300 may further enhance the example lighting handshake described in FIGS. 3A-3C by illuminating the area of the user 304 using a beam of light, LEDs positioned below the user 304, and/or other types of lights. In particular, the interactive system 300 may use sensor information to determine a position of the user 304. Based on the position of the user, the interactive system 300 may estimate an area that encompasses user 304 and illuminate the estimated area using light (e.g., beams of light) as an element of a lighting handshake. As such, the interactive system 300 is shown illuminating the area of the user 304 after illuminating the podium and/or ground lights positioned around the user.

In some instances, the interactive system 300 may illuminate a determined area as an essential part of a lighting handshake. For instance, the lighting system may illuminate the podium using a beam of light and consequently move the illumination towards the user 304 or increase the size of the light beam until encompassing the area of the user. Likewise, the lighting system may initially illuminate the determined area that includes user 304 and further extend the illumination in a gradual motion to include the podium 302.

As previously indicated, the interactive system 300 may use various combinations of lights to perform an interactive lighting handshake. As such, the interactive system 300 may use any of the illumination processes described in FIGS. 3A-3D during an example lighting handshake. The interactive system 300 may combine the different possible illumination processes and may use the processes in various orders. Other example lighting handshakes may include other illumination processes, which may include more or less lighting effects.

Figure 4A:
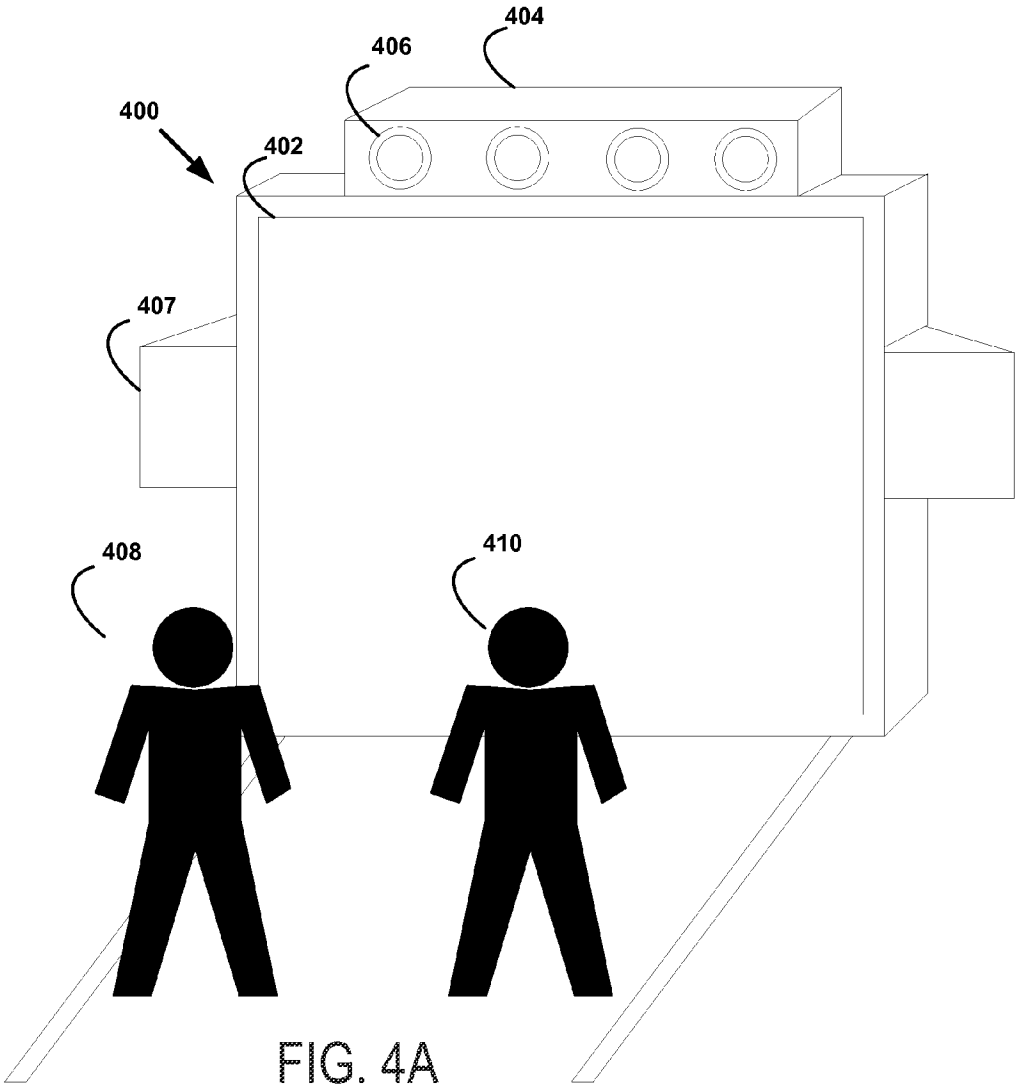
FIG. 4A illustrates another interactive system implementing an initial aspect of the example interactive lighting handshake.

FIG. 4A illustrates another interactive system implementing an initial aspect of the example interactive lighting handshake. As shown, the interactive system 400 differs from the interactive system 300 described in FIGS. 3A-3D and includes a screen interface 402, a lighting system 404 having multiple lights 406 built in and speakers 407. The interactive system 400, however, may include other components, interfaces, and/or sensors with other examples. For instance, the interactive system 400 may include a microphone array, cameras, motion sensors, and/or other possible components.

During operation, similar to the other systems described herein, the interactive system 400 may perform one or more interactive lighting handshakes to further enhance the experience of users. As such, the interactive system 400 may use sensor data to detect the presence of a user or multiple users in order to determine when to initiate a lighting handshake process. For instance, the interactive system 400 may perform lighting handshake upon detecting the presence of user 408 and user 410 within sensor data. In examples, the interactive system 400 may select and perform a particular lighting handshake to further engage users 408-410 and possibly convey information relating to controlling the interactive system 400.

Figure 4B:
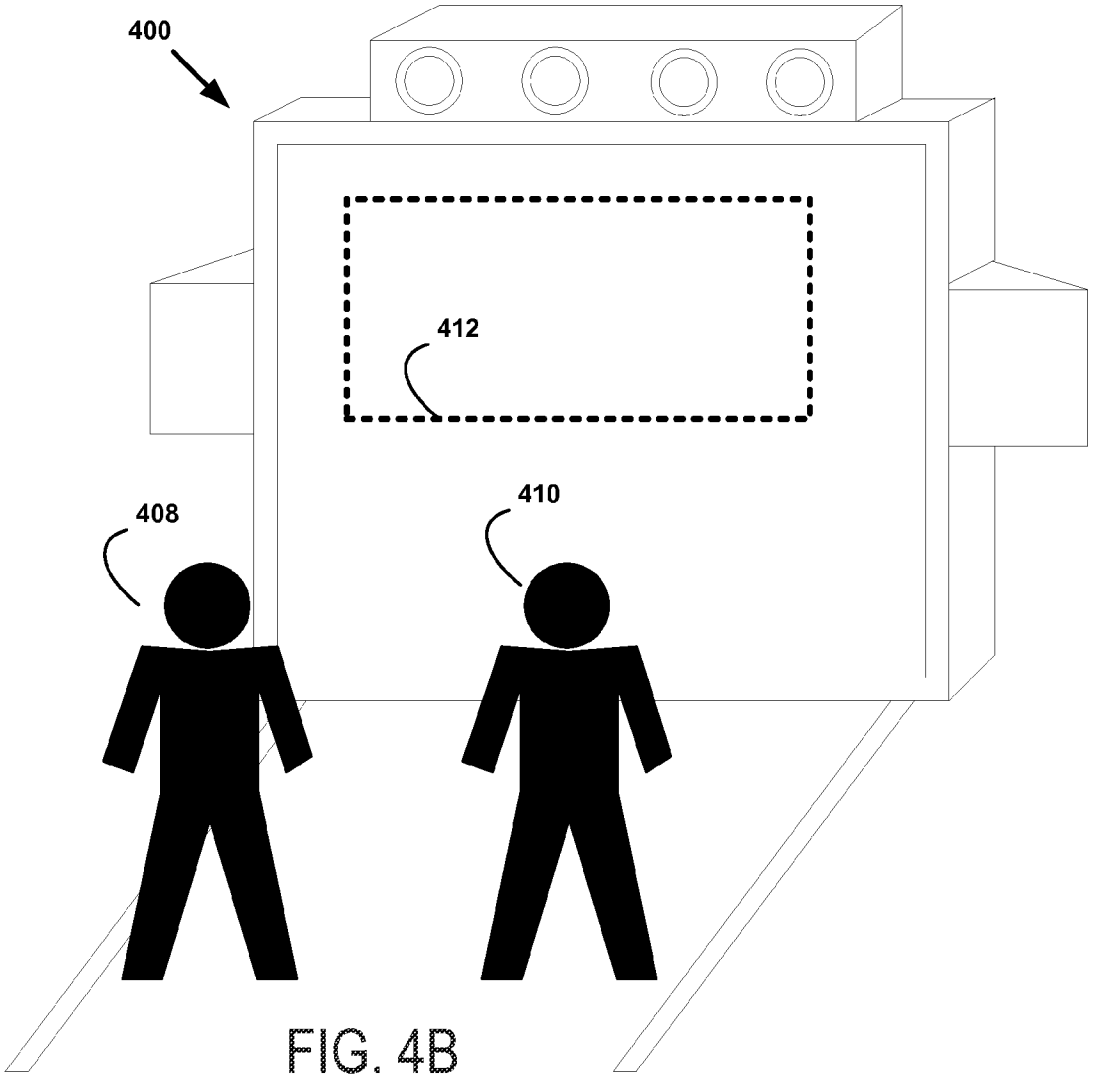
FIG. 4B illustrates the interactive system of FIG. 4A implementing another aspect of the example interactive lighting handshake.

FIG. 4B illustrates the interactive system of FIG. 4A implementing another aspect of the example interactive lighting handshake. In particular, the illustration of FIG. 4B shows the interactive system 400 illuminating area 412 on the screen as an initial step of an example lighting handshake. During operation, the interactive system 400 may illuminate area 412 with graphics, lights, and/or visual messages for the users 412. Furthermore, the interactive system 400 may illuminate other portions of the screen, including the entire screen during the performance of a handshake in other examples.

In another example implementation of a lighting handshake, the interactive system 400 may activate and turn on the screen in response to detecting the users 408-410. Furthermore, the interactive system 400 may illuminate the screen in a variety of ways. For instance, similar to a television, the system 400 may illuminate the screen via backlight LEDs or providing graphical interfaces to display. Likewise, an interactive handshake may involve illuminating the screen using lights positioned separately from the screen, such as lights positioned in a physically separate lighting system.

Further, in some examples, in addition to illuminating area 412 of the screen during an interactive lighting handshake, the interactive system 400 may attribute other signals during the illumination of the screen, which may include vibrating the floor beneath the users 408-410 and/or may play sound effects from speakers 407.

Figure 4C:
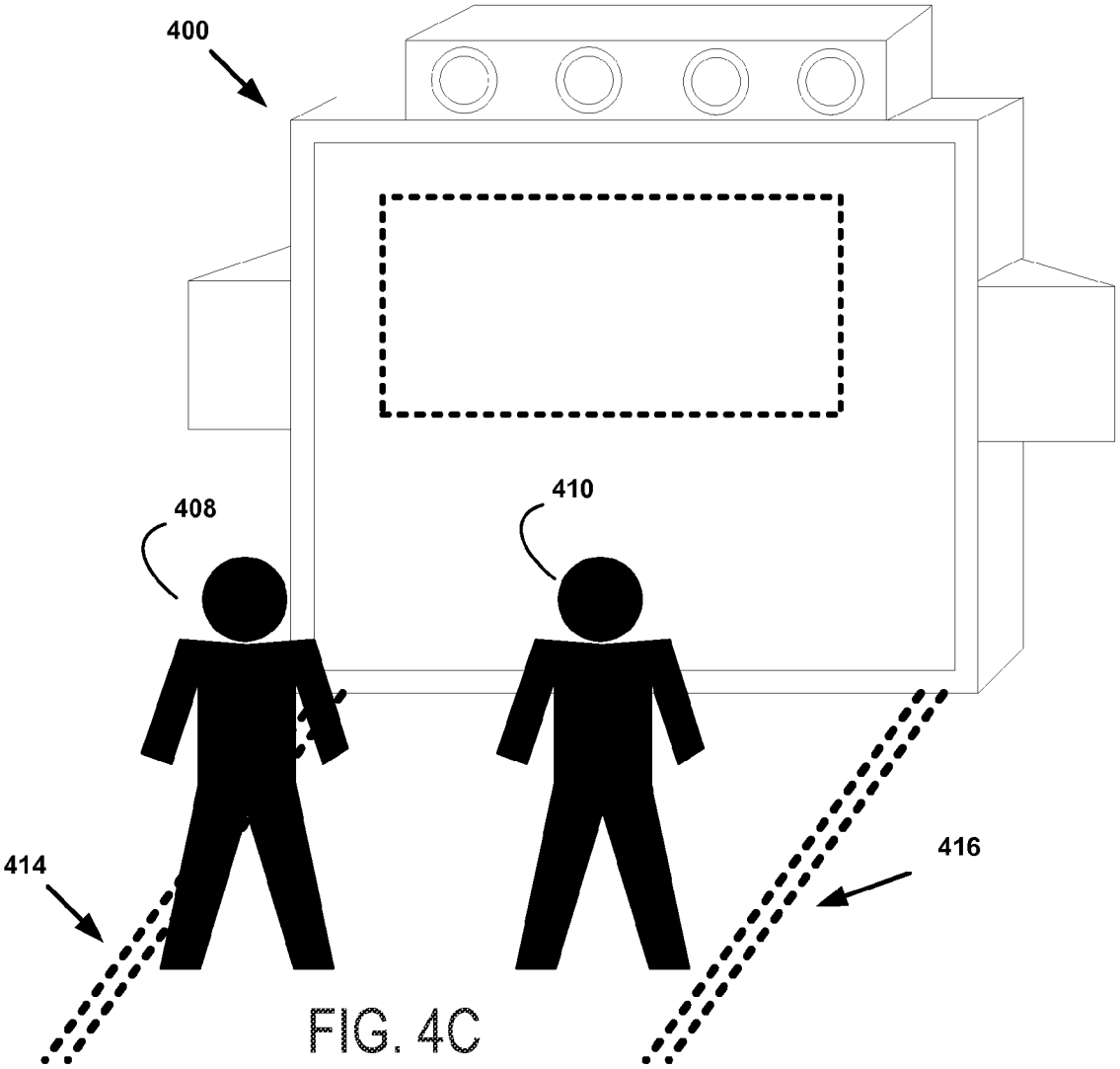
FIG. 4C illustrates the interactive system of FIGS. 4A-4B implementing an additional aspect of the example interactive lighting handshake.

FIG. 4C illustrates the interactive system of FIGS. 4A-4B implementing an additional aspect of the example interactive lighting handshake. As such, the illustration shows the interactive system 400 illuminating ground lights 414 and grounds lights 416 positioned on the sides of users 408-410 as another step of the example interactive lighting handshake described herein. In some examples, the grounds lights 414-416 may correspond to white or colored LEDs.

Similar to the example interactive handshake discussed with regards to FIGS. 3A-3D, the interactive system 400 may illuminate the grounds lights 414-416 during the performance of an interactive lighting handshake. As shown in FIG. 4C, the interactive system 400 may illuminate the ground lights 414-416 after illuminating the screen or an aspect of the screen. In other implementations, parameters associated with the ground lights 414-416, such as the position, size, and type of lights, may vary.

Furthermore, the interactive system 400 may illuminate the individual lights in the ground lights 414-416 in various orders. For instance, during some interactive handshakes, the interactive system 400 may illuminate all the lights in the ground lights 414-416 simultaneously. In other instances, the interactive system 400 may illuminate the lights in the grounds lights individually in some sort of order. Further, the illumination of the ground lights 414 may mirror the illumination of the ground lights 416. Additionally, in other examples, the interactive system 400 may include more lights positioned in front and center of the screen. This may enable the interactive system 400 to illuminate lights positioned under users.

Figure 4D:
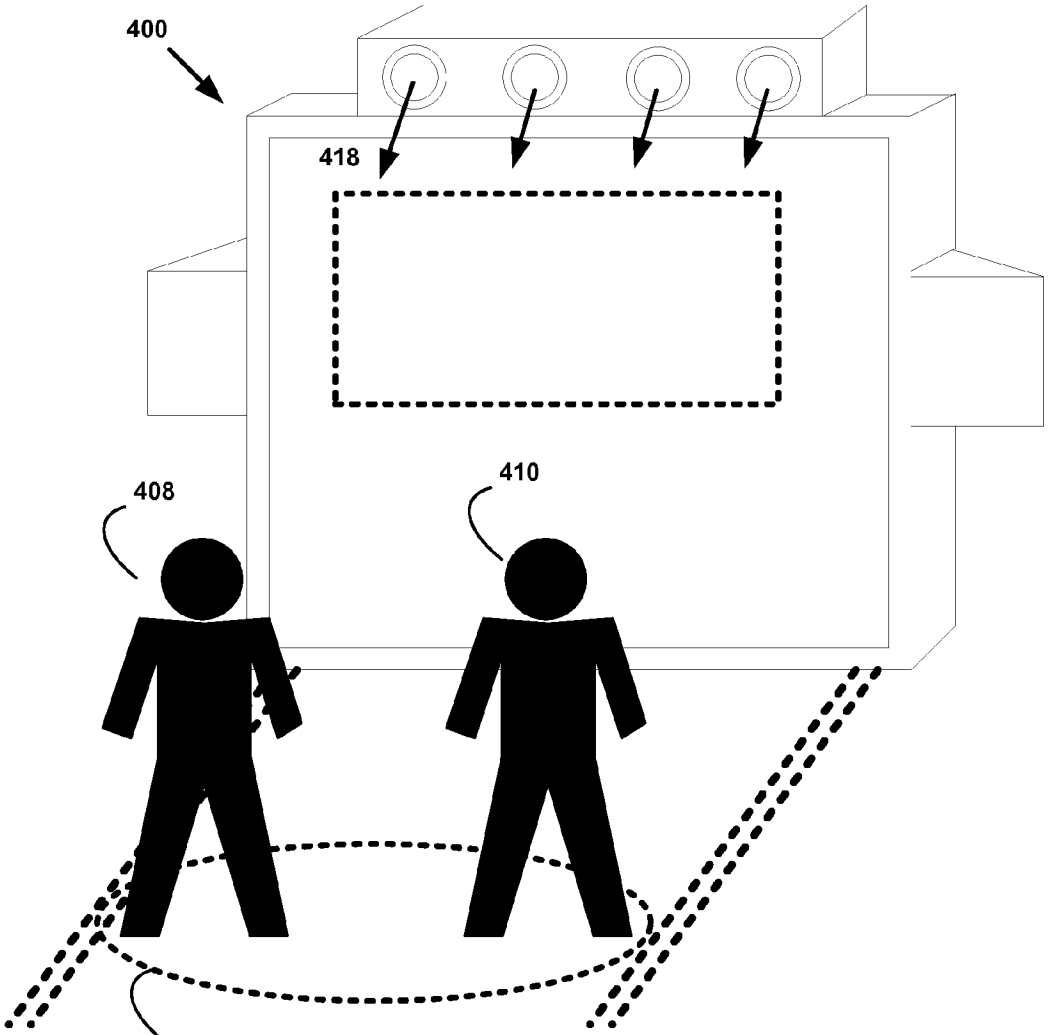
FIG. 4D illustrates the interactive system of FIGS. 4A-4C implementing a further aspect of the example interactive lighting handshake.

FIG. 4D illustrates the interactive system of FIGS. 4A-4C implementing a further aspect of the example interactive lighting handshake. In particular, FIG. 4D shows the interactive system 400 illuminating a determined area 420 that encompasses the users 408-410 using one or more light beams 418 shown coming from the lights 406 of the light system 404.

As indicated, an example interactive system may illuminate an area encompassing users in order to further engage the users and enhance the experience of the users. As such, the interactive system 400 is shown illuminating a determined area 420 using beams of light 418. This illumination of the determined area 420 may occur after the interactive system 400 performs other steps or processes within an interactive lighting handshake, such as the elements of the handshake shown in FIGS. 4B-4C, for example. In other examples, the interactive system 400 may illuminate the area encompassing the users 408-410 to start an interactive lighting handshake or during the middle of an example lighting handshake. Likewise, in some examples, the interactive system 400 may perform lighting handshakes without using any beams of light from the lighting system 404.

In some examples, the interactive system 400 may determine a 3D volume for illuminating using beams of lights from the lighting system 404 based on the height of the users 408-410. In particular, the interactive system 400 may determine the 3D volume when using one or more beams of light positioned above the users so that the beams shine down on the users in a downward motion. Other examples of areas and volumes for executing an interactive lighting handshake may exist.

Further, in other examples, the interactive system 400 may use the beams of light 418 to illuminate other areas, components, and/or interfaces positioned within range of the interactive system 400. For instance, the interactive system 400 may further include one or more chairs, podiums, and/or other physical structures that the interactive system 400 may illuminate using beams of light 418 during a lighting handshake.

In another example of performing an interactive lighting handshake, the interactive system 400 may illuminate multiple areas using the light beams 418 from lights 406 of the lighting system 404. In particular, the interactive system 400 may illuminate a first area encompassing user 408 and may further illuminate a second are encompassing user 410. Further, the lighting system 404 may adjust colors or other parameters of light beams 418 to further convey information to the user. For example, if the users 408-410 are providing motion or other form of inputs to the interactive system 400, the lighting system 404 may convey the user 408 currently in control of the interactive system 400 or other information based on parameters associated with the light beams 418.

In a further example implementation of a lighting handshake, the interactive system 400 may initially illuminate the area 420 and move the light gradually towards the screen 402 in a visual presentation. In particular, the users 408-410 may watch as the illumination of lights changes position from an area encompassing their current position towards the screen 402 of the system 400. As such, the interactive system 400 may use beams of lights 418 or other types of light to implement a given lighting handshake. For instance, the interactive system 400 may use the beams of lights 418 to illuminate aspects and move the illuminations.

It should be understood that arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims, along with the full scope of equivalents to which such claims are entitled. It is also to be understood that the terminology used herein is for the purpose of describing particular embodiments only, and is not intended to be limiting.

Since many modifications, variations, and changes in detail can be made to the described example, it is intended that all matters in the preceding description and shown in the accompanying figures be interpreted as illustrative and not in a limiting sense.

What is claimed is:

1. A method comprising:

detecting, at a computing device associated with a light system using one or more sensors associated with the computing device, a user in a position within a threshold distance from an interface of the computing device, wherein the interface of the computing device is a screen on a podium;

responsive to detecting the user, determining an area that encompasses the position of the user; and causing, by the computing device, the light system to illuminate the determined area using a light handshake, wherein the light handshake comprises illuminating a given aspect of the interface of the computing device and subsequently extending the illumination in a visual presentation from the given aspect of the interface of the computing device to encompass the position of the user.

2. The method of claim 1, further comprising:

detecting a change in the position of the user above a threshold distance from the interface;

based on detecting the change in the position of the user above the threshold, causing the light system to stop illuminating the position of the user and subsequently stop illuminating the given aspect of the interface of the computing device.

3. The method of claim 1, wherein detecting the user in the position proximate to the interface of the computing device comprises:

receiving, from one or more sensors associated with the computing device, sensor data indicative of a presence of the user; and based on the sensor data, detecting the user in the position proximate to the interface of the computing device.

4. The method of claim 1, wherein the light handshake comprises:

illuminating a plurality of light emitting diodes (LEDs) positioned on a ground surface around the position of the user.

5. The method of claim 1, further comprising:

detecting a change in the position of the user proximate to the computing device; and based on detecting the change in the position of the user, causing the light system to adjust one or more parameters of the light handshake.

6. The method of claim 5, wherein causing the light system to adjust one or more parameters of the light handshake comprises:

causing the light system to adjust a color associated with the light handshake to signal position information to the user.

7. The method of claim 5, wherein causing the light system to adjust one or more parameters of the light handshake comprises:

causing the light system to adjust the light handshake to position light around a new position of the user.

8. The method of claim 1, further comprising:

providing, by the computing device, one or more signals in addition to the light handshake, wherein the one or more signals include one or both of an audio signal and a vibration signal.

9. The method of claim 1, wherein the light handshake includes one or more color lights, wherein a given color light of the one or more color lights is indicative of control information associated with the computing device.

10. The method of claim 1, wherein extending the illumination in the visual presentation from the given aspect of the interface of the computing device to encompass the position of the user comprises:

modifying the illumination to illuminate an area between the given aspect of the system and the position of the user prior to illuminating the position of the user.

11. A system comprising:

one or more processors;

one or more sensors;

a light system; and a memory having stored thereon instructions that, upon execution by the one or more processors, cause the system to perform functions comprising:

detecting, using sensor data from the one or more sensors, a user in a position within a threshold distance from an interface of the system, wherein the interface of the system is a screen on a podium of the system;

responsive to detecting the user, determining an area that encompasses the position of the user; and causing the light system to illuminate the determined area using a light handshake, wherein the light handshake comprises illuminating a given aspect of the interface of the system and subsequently extending the illumination in a visual presentation from the given aspect of the interface of the system to encompass the position of the user.

12. The system of claim 11, wherein the light handshake comprises illuminating the given aspect of the computing device using one or more light beams, and wherein subsequently extending the illumination in the visual presentation from the given aspect of the interface of the system to encompass the position of the user comprises:

extending the one or more light beams from the given aspect of the interface of the system towards the position of the user until the one or more light beams encompass the position of the user.

13. The system of claim 11, wherein extending the illumination in the visual presentation from the given aspect of the interface of the system to encompass the position of the user comprises:

illuminating additional areas between the given aspect of the interface of the system and the position of the user in a sequential order until the illumination extends from the given aspect of the interface of the system to encompass the position of the user.

14. The system of claim 11, further comprising:

detecting a change in the position of the user above a threshold distance; and based on detecting the change in the position of the user above the threshold distance, causing the light system to stop illuminating the determined area using the light handshake.

15. A non-transitory computer readable medium having stored therein instructions, that when executed by a computing device, cause the computing device to perform functions comprising:

detecting, using one or more sensors, a user in a position within a threshold distance from an interface of the computing device, wherein the interface of the computing device is configured to receive input from the user and the interface of the computing device is a screen on a podium;

responsive to detecting the user, determining an area that encompasses the position of the user; and causing a light system to illuminate the determined area using a light handshake, wherein the light handshake comprises illuminating a given aspect of the interface of the computing device and subsequently extending the illumination in a visual presentation from the given aspect of the interface of the computing device to encompass the position of the user.

16. The non-transitory computer readable medium of claim 15, further comprising:

causing the illumination to stretch and fade away as the user changes position above a threshold distance from the interface.

17. The non-transitory computer readable medium of claim 15, wherein extending the illumination in the visual presentation from the given aspect of the interface of the system to encompass the position of the user comprises:

illuminating additional areas between the given aspect of the interface of the system and the position of the user in a sequential order until the illumination extends from the given aspect of the interface of the system to encompass the position of the user.

18. The non-transitory computer readable medium of claim 15, wherein the light handshake includes one or more color lights, wherein a given color light of the one or more color lights is indicative of control information associated with the computing device.

* * * * *